United States Patent [19]

Jepsen

[11] 4,322,950

[45] Apr. 6, 1982

[54] COMBINED INTERNAL COMBUSTION AND STEAM ENGINE

[76] Inventor: Marshall P. Jepsen, 237 San Ysidro Rd., Santa Barbara, Calif. 93108

[21] Appl. No.: 189,894

[22] Filed: Sep. 22, 1980

[51] Int. Cl.[3] ..... F01B 29/04

[52] U.S. Cl. ..... 60/712; 123/1 R; 123/25 D; 123/25 P

[58] Field of Search ..... 60/712; 123/25 P, 25 C, 123/25 D, 1 R

[56] References Cited

U.S. PATENT DOCUMENTS

| | | | |
|---|---|---|---|
| 1,424,798 | 8/1922 | Black | 60/712 |
| 1,629,677 | 5/1927 | Bull | 60/712 |
| 1,711,937 | 5/1929 | Glantz | 123/25 P |
| 1,782,642 | 11/1930 | Wiley | 123/25 P |
| 2,001,577 | 5/1935 | Johnson | 60/712 |
| 2,671,311 | 3/1954 | Rohrbach | 60/712 |
| 4,122,803 | 10/1978 | Miller | 123/25 P |
| 4,143,518 | 3/1979 | Kellogg-Smith | 60/712 |

*Primary Examiner*—Ira S. Lazarus
*Attorney, Agent, or Firm*—Harry W. Brelsford

[57] ABSTRACT

My invention relates to internal combustion engines that are intermittently operated as steam engines with the changeover from one phase to the other controlled by the heat of the metal of the engine in the region of the combustion.

5 Claims, 5 Drawing Figures

COMBINED INTERNAL COMBUSTION AND STEAM ENGINE

BACKGROUND OF THE INVENTION

The injection of water into internal combustion engines has been practiced for decades. The heat of the engine causes the water to change to steam at a high pressure. When this water injection is timed with the combustion of fuel, the steam adds additional pressure to the combustion gasses and increases the power of the power stroke of piston engines.

The prior devices generally fall into one of two classes. One class is the injection of water to cool the products of combustion in the combustion by forming steam. The other class uses the heat of the metal surrounding the combustion chamber to generate steam. In both cases, the steam is introduced into the combustion chamber to add power to the power stroke.

BRIEF SUMMARY OF THE INVENTION

I have devised a steam phase of operation for internal combustion engines that is not a supplement to the products of combustion. Instead, the engine alternates between fuel combustion and steam operation. In my new type of engine, there is no water-cooling jacket for the cylinder head and, alternatively, for side walls also. The metal of the head, therefore, gets hot in the order of 500° F. This or any other selected temperature is sensed and automatically shuts off the fuel supply and automatically injects water. The water passing thru the hot head and striking the hot air in the combustion chamber and the hot top of the piston is instantly vaporized and converted to steam. The steam pressure operates the engine until the temperature of the metal around the combustion chamber drops to a pre-selected minimum. At that minimum temperature, the water injection ceases and the fuel system is automatically energized. The continued combustion of fuel raises the temperature of the metal until the pre-selected minimum temperature is reached, whereupon the cycle repeats.

A steam engine is essentially a two-cycle engine in combustion engine terms, and I presently prefer to utilize a two-cycle engine with my steam phase operation. My steam phase works effectively with four-cycle internal combustion engines, although somewhat less efficiently.

DETAILED DESCRIPTION

Various objects, advantages, and features of the invention will be apparent in the following description and claims considered together with the drawings forming an integral part of this specification in which:

Figure 2:
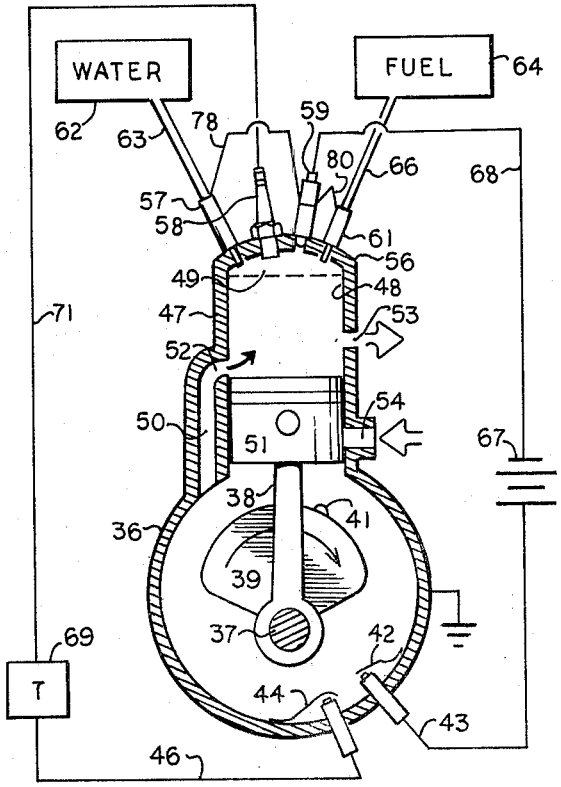
FIG. 2 is a schematic view of a two-cycle engine in full section equipped also with a heat sensor, fuel injector, and water injector in accordance with the invention.

Referring to FIG. 2, there is illustrated a four-cycle engine having a metal block 10 defining a working chamber or cylinder 11 in which reciprocates a piston 12 having a wrist pin 13 with a connecting rod 14 secured thereto. Secured to the top of block 10 is a massive metal head 16 having a spark plug 17 threaded therein and a fuel injector 18, a water injector 19, and a heat sensor 21 secured therein. The working chamber is defined by the space beneath the head 16; and the combustion chamber in this particular design is formed by depression or chamber 22 formed in the top of the piston 12. Any suitable construction of engine that produces a combustion chamber would be equally effective.

Figure 1:
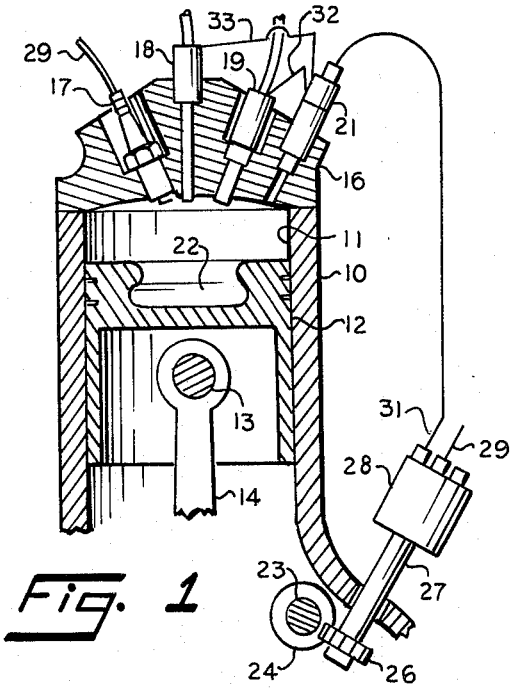
FIG. 1 is a elevation view in section of a schematic cylinder, piston, and cylinder head showing a heat sensor, water injector, and fuel injector in accordance with the invention.

The engine of FIG. 1 is a four-cycle engine and its time may be regulated by the usual cam shaft 23 having a worm gear 24 engaged by a pinion gear 26 on a distributor shaft 27 driving a distributor 28, which is modified to not only give spark currents but also electrical currents for the operation of either the fuel injector 18 or the water injector 19. Accordingly, the distributor 28 may have a wire 29 leading to the spark plug 17 through any suitable spark coil or transformer, and another wire 31 may lead to the heat sensor 21 where the heat sensor will direct the current either thru a wire 32 leading to the water injector 19 or to a wire 33 leading to the fuel injector 18.

In operation, the device of FIG. 1 may be a single-cylinder engine or a multiple-cylinder engine as desired, and the usual inlet and exhaust valves are not shown, inasmuch as any suitable valves can be used, and these in turn would be operated by the cam shaft 23 so as to effect the four-cycle operation of the engine. The engine of FIG. 1 has no water cooling in the head of 16 and preferably a very little water-cooling in the top of the block 10 adjacent to the head 16. In operation, as a normal fuel-injected engine on the compression stroke, the piston 12 moves upwardly, and when trapped air is sufficiently compressed the distributor 28 causes a current to go through the wire 29 to the spark plug 17 to cause ignition of fuel in the combustion chamber, which in this case is located in the cavity 22 in the piston 12. The distributor 28 also sends a current thru wire 31 to the heat sensor 21, which directs a current thru wire 33 to the fuel injector 18 to cause a measured quantity of fuel to be injected into the top of the working chamber 11, and at this point the piston 12 is very close to the head 16. The resulting heating of the compressed air by the fuel causes the piston 12 to move downwardly in the well known four-cycle power stroke. After continued operation as an internal combustion engine, the head 16 will become extremely hot, due to the lack of water cooling, and this temperature is sensed by the sensor 21. When this temperature exceeds a determined amount, for example, 700° F., then the sensor switches off the fuel wire 33 and directs current to the water injector wire 32, whereupon, water is injected into the combustion chamber. The water is immediately turned to steam, because of the heat of the head, the heat of the metal of the piston 12, the heat derived from the block 10, and the heat derived from compressing air or other gasses at the top dead center of the piston stroke. This water turns to steam, because of heat just mentioned, and forms the power for driving the piston 12 downwardly in the working chamber 11. After a number of such steam strokes, the metal of the head 16 has decreased in temperature sufficiently so that a lesser amount of power is derived from the steam stroke, whereupon this decreased temperature is sensed by the sensor 21, and the wire 32 is automatically disconnected, and the wire 33 connected to the distributor 28 to send an electric impulse to the fuel injector 18. Thereafter, the engine operates as an internal combustion engine, until the temperature of the head again reaches a point where the steam operation is feasible.

Referring now to FIG. 2, there is illustrated a two-cycle engine, wherein every downward stroke of the piston is a power stroke. A crank case section 36 supports a crank shaft 37, to which is connected a connecting rod 38 and also a counter balance weight 39. Projecting from the counter balance weight 39 is a cam 41, which when it rotates toward the bottom of the crank case 36 first strikes a switch finger 42, which closes a switch to a wire 43 insulated from the crank case 36. The cam 41 next strikes a switch finger 44, which closes a switch circuit to a wire 46, which also is insulated from the crank case 36.

Secured to the top of the crank case 36 is an engine block 47, which defines a working chamber 48 and a combustion chamber 49 indicated by the broken line which is the top dead center of a piston 51 that is connected to the connecting rod 38 and which reciprocates within the working chamber 48.

During the downward stroke of the piston 51 it compresses air in the crank case 36, and this air is forced up a channel 50 to an inlet port 52 for the working chamber of 48. Upward movement of the piston 51 closes off this inlet port 52 and further upward movement closes off an exhaust port 53, whereupon the trapped air is compressed in the combustion chamber 49. This upward movement of the piston creates partial vacuum in the crank case 36, allowing air to flow from atmosphere thru an inlet port 54 in the cylinder traversed by the piston 51.

Referring now to the upper part of FIG. 2, the top of the combustion chamber 49 is defined by a metal head 56, and secured in this head 56 is a water injector 57, a spark plug 58, a heat sensor 59, and a fuel injector 61. The water injector 57 is supplied by water reservoir 62 connected by a tube 63 to the injector. The fuel for the fuel injector 61 is supplied by a reservoir 64 connected by a tube 66 to the fuel injector. Electrical current for the injectors is supplied by any suitable source represented by a battery 67 connected by a wire 68 to the heat sensor 59. The spark plug 58 may be energized in any suitable fashion, and there is illustrated a transformer or spark coil 69 connected to the wire 46. This, in turn, delivers its output thru a wire 71 to the spark plug 58.

Figure 3:
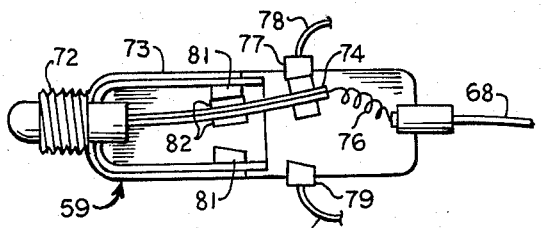
FIG. 3 is a schematic view on an enlarged scale of the heat sensor of FIG. 2 and the mechanism for switching from water to fuel.

Referring now to FIG. 3, there is illustrated the heat sensor 59 of FIG. 2, and this heat sensor carries out two functions: one, sense the heat, and two, to switch from water to fuel depending upon the heat sensed. The sensor 59, accordingly, may have a metal stem 72, which is threaded into the head 56; connected to this stem 72 is an envelope 73 in which is disposed any suitable temperature responsive device, and there is illustrated a bimetal 74 connected to the wire 68 by a flexible conductor 76. In the position illustrated in FIG. 3, the bimetal 74 closes on a contact 77 connected to a wire 78 which in turn is connected to the water injector 57. On the opposite side of the envelope 73 is an electrical contact 79 connected to a wire 80 leading to the fuel injector 61. The bimetal 74 is held in the lefthand position illustrated or in the righthand position against contact 79 by any suitable apparatus. There is illustrated a pair of permanent magnets 81 with tracked magnetic metal pieces 82 disposed one on each side of the bimetal 74. The magnetic attraction holds the bimetal 74 in one position until there is such a great change of temperature that the magnetic attraction is overcome, whereupon the bimetal 74 will then snap over to the other side of the capsule to be held by the opposite magnet 81. In this fashion, a switch is closed for a high temperature, but it will not reverse the switching until a much lower temperature is achieved and vice-versa, as sensed by the threaded metal shank 72.

Figure 4:
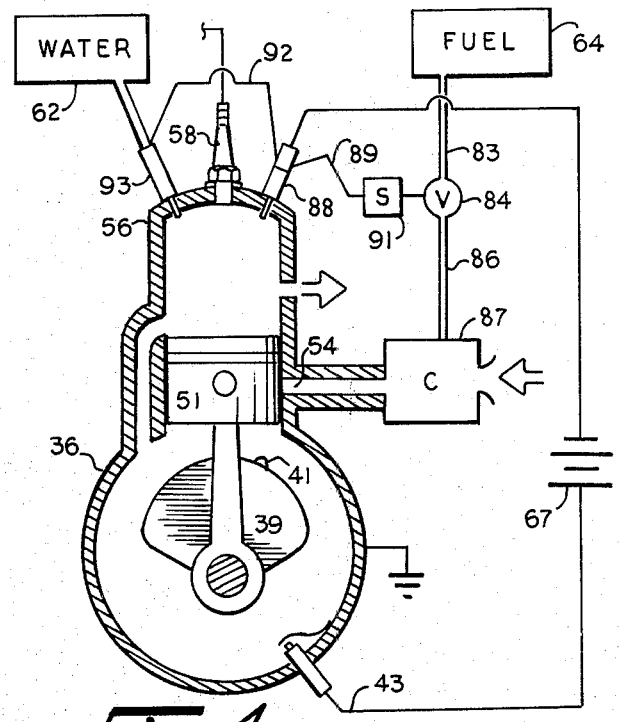
FIG. 4 is a diagram of the two-cycle engine similar to FIG. 2, but illustrating the use of carbureted fuel instead of fuel injection.

Referring to FIG. 4, there is illustrated the engine of FIG. 2, but wherein the fuel is carbureted rather than injected into the combustion chamber. In the figure fuel reservoir 64 is connected by a tube 83 to a solenoid valve 84 from which a tube 86 leads to a carburetor 87, which adds fuel to air passing thru the intake port 54 of the two-cycle engine. A heat sensor 88 is mounted in the head of the engine, and a wire 89 leads to a solenoid 91, which opens the normally closed valve 84. Leading from the opposite side of the heat sensor 88 is a wire 92 leading to a water injector 93. The spark plug 58 may be energized in any suitable fashion.

The engine of FIG. 4 operates as a conventional carbureted two-cycle engine until such time as the heat builds up in the head 56, whereupon the sensor 88 switches off the solenoid 91. This causes the valve 84 to close, and switches on the fuel injector 93, whereupon the water is injected into the combustion chamber at the appropriate time in the cycle to cause steam to form and thereby create a power stroke for the piston 51.

Figure 5:
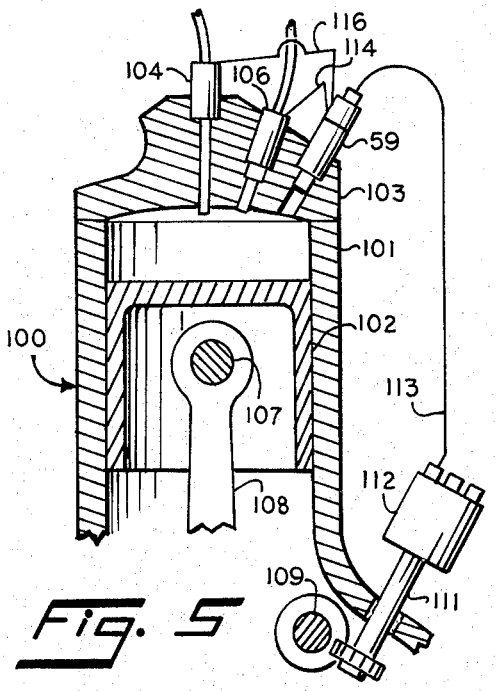
FIG. 5 is a full section diagram of a diesel engine using the invention.

Referring to FIG. 5, there is illustrated the invention as applied to a diesel-cycle engine 100 having a cylinder wall 101, a piston 102 reciprocable therein, and a cylinder head 103 preferably devoid of cooling of any type. Disposed in the head 103 is an electric fuel injector 104, an electric water injector 106, and a thermal sensing unit 59, which can have the same structure as that of FIG. 3. The piston 102 has the usual wrist pin 107 to which is secured a connecting rod 108 connected to the usual crankshaft (not shown) which in turn is geared to a camshaft 109, which drives a distributor shaft 111 connected to a distributor 112.

Leading from the distributor 112 is a wire 113 connected to the thermal sensor 59, and the sensor directs an electric current through a wire 114 to the electric water injector 106 or, alternatively, through a wire 116 to the electric fuel injector 104.

The operation of the engine of FIG. 5 depends upon the usual diesel compression generating enough heat to fire the fuel injected by the electric fuel injector 104 as the piston 102 is near the top of its stroke. The fuel injection is caused by the distributor 112 sending an electric impulse through wires 113 and 116 to this fuel injector 104. When the head 103 becomes sufficiently heated, the sensor 59 switches off the fuel injector and switches on the water injector 106 as explained as to FIG. 3. The heat of compression of the gases in the combustion chamber and the heat of the metal of the head 103, the cylinder walls 101, and the piston 102 causes the injected water to immediately turn into steam, creating the driving force that pushes the piston 102 downwardly. This water-steam stroke will occur at every other piston reciprocation inasmuch as a diesel is ordinarily a four-cycle engine. A two-cycle engine could be used if desired, obtaining diesel or steam power on every stroke, as explained with reference to FIG. 2. The gearing for the distributor would, of course, be changed for such two-cycle operation. When the compressed air and the surrounding metal drop sufficiently in temperature, the sensor 59 switches the water injector 106 off and switches on the fuel injector 104, and the engine operates as a diesel engine until it again heats up.

It will be apparent from the presently preferred embodiments of my invention that the heat of the metal of the block and the head is utilized to create energy rather than having this heat wasted through the radiator or through cooling fins as is presently conventional. While the engine is being operated in the steam phase, the fuel is cut off, thereby effectively saving fuel. It will be appreciated by those skilled in the art that any suitable sensor and any suitable temperature-responsive switch may be used, and the device of FIG. 3 is merely illustrative of a wide variety of such mechanisms that are available.

Various modifications and improvements will be apparent to those skilled in the art, and, accordingly, the present invention is not limited to the device disclosed or illustrated, and I include within the scope of the following claims all such variations and modifications that fall within the true spirit and scope of the invention.

I claim:

1. An internal combustion engine that operates on alternating internal combustion and steam phases comprising:

(a) metal defining a combustion chamber and a working chamber.

(b) a piston reciprocable within the working chamber;

(c) means for introducing fuel into the combustion chamber;

(d) means for introducing water into the combustion chamber;

(e) means for selectively actuating the fuel-introducing means or the water-introducing means;

(f) and a sensor for sensing the heat of the metal and connected to the selectively actuating means to actuate either the water-introducing means or the fuel-introducing means, whereby the engine may be operated automatically as a steam engine when the heat of the metal exceeds a predetermined temperature and may be operated as an internal combustion engine when the temperature of the metal is below a preselected minimum.

2. An engine as set forth in claim 1 wherein the engine is a two cycle engine and there are provided means for timing the water introduction on every stroke of the piston during the steam phase of operation.

3. An engine as set forth in claim 1 wherein the engine is a four-cycle engine and there are provided means for timing the water introduction on every other stroke of the piston during the steam phase of operation.

4. An engine as set forth in claim 1 wherein the water is introduced into the combustion chamber and the upper part of the working chamber.

5. An engine as set forth in claim 1 wherein the water is introduced into the combustion chamber.

* * * * *